US011840096B2

(12) United States Patent
Wachi et al.

(10) Patent No.: US 11,840,096 B2
(45) Date of Patent: Dec. 12, 2023

(54) SEMICONDUCTOR DEVICE

(71) Applicants: SEIKO EPSON CORPORATION, Tokyo (JP); ROHM Co., Ltd., Kyoto (JP)

(72) Inventors: Hiroki Wachi, Suwa (JP); Koji Nishi, Kyoto (JP); Tomohiro Nishimura, Kyoto (JP)

(73) Assignees: SEIKO EPSON CORPORATION, Tokyo (JP); ROHM Co., Ltd., Kyoto (JP)

( * ) Notice: Subject to any disclaimer, the term of this patent is extended or adjusted under 35 U.S.C. 154(b) by 367 days.

(21) Appl. No.: 17/231,028

(22) Filed: Apr. 15, 2021

(65) Prior Publication Data

US 2021/0323316 A1 Oct. 21, 2021

(30) Foreign Application Priority Data

Apr. 16, 2020 (JP) ..... 2020-073664

(51) Int. Cl.
*B41J 2/355* (2006.01)

(52) U.S. Cl.
CPC ..... *B41J 2/3556* (2013.01)

(58) Field of Classification Search
CPC ..... B41J 2/3556
See application file for complete search history.

(56) References Cited

U.S. PATENT DOCUMENTS 5,191,357 A * 3/1993 Ono ..... B41J 2/17 347/186
2015/0002566 A1 1/2015 Kudo et al.

FOREIGN PATENT DOCUMENTS

| | | |
|---|---|---|
| CN | 104275931 | 1/2015 |
| JP | H0592603 | 4/1993 |
| JP | 2003154697 | 5/2003 |
| JP | 2015009529 | 1/2015 |
| JP | 2021-030579 | 3/2021 |

* cited by examiner

*Primary Examiner* — Justin Seo
(74) *Attorney, Agent, or Firm* — JCIPRNET

(57) ABSTRACT

A semiconductor device is adapted for controlling energization of a heating element that performs printing. The semiconductor device includes: a strobe signal input unit receiving a printing strobe signal that causes the heating element to generate heat for printing; a preheating strobe generation circuit generating a preheating strobe signal that causes the heating element to preheat by compressing a waveform of the printing strobe signal in a time axis direction; and an output controller outputting a control signal that controls energization of the heating element based on the printing strobe signal and the preheating strobe signal.

11 Claims, 5 Drawing Sheets

SEMICONDUCTOR DEVICE

The present application is based on, and claims priority from JP Application Serial Number 2020-073664, filed Apr. 16, 2020, the disclosure of which is hereby incorporated by reference herein in its entirety.

BACKGROUND

1. Technical Field

The present disclosure relates to a semiconductor device.

2. Related Art

JP-A-2003-154697 is an example of the related art and discloses a printer that includes a thermal head having a plurality of heating elements for printing on paper or the like, and a control unit for performing heating control on the heating elements. The control unit includes a temperature detection unit for detecting the temperature of the thermal head, a heating time acquisition unit for acquiring the heating time required for heating to a temperature that does not lead to printing of the heating elements based on the detected temperature, and a printing unit for the heating elements that did not generate heat for printing to heat for preheating based on the acquired heating time after printing.

In such a printer, the heating for printing and preheating are alternately performed so that the thermal head can be maintained at a predetermined temperature less than that for printing. As a result, high-speed printing can be performed without slowing down the printing speed.

In addition, the control unit for performing heating control includes a microprocessor, and the microprocessor controls the heating for printing and preheating via the printing unit. The printing unit controlled by the microprocessor alternately transfers strobe signals for printing and strobe signals for preheating to the thermal head. As a result, in the thermal head, the heating for printing and preheating can be alternately performed.

However, in order to control both printing and preheating, the microprocessor is required to have high performance. Therefore, it is difficult to reduce the cost of the printer.

SUMMARY

A semiconductor device according to an aspect of the present disclosure is adapted for controlling energization of a heating element that performs printing. The semiconductor device includes: a strobe signal input unit receiving a printing strobe signal that causes the heating element to generate heat for printing; a preheating strobe generation circuit generating a preheating strobe signal that causes the heating element to preheat by compressing a waveform of the printing strobe signal in a time axis direction; and an output controller outputting a control signal that controls energization of the heating element based on the printing strobe signal and the preheating strobe signal.

DESCRIPTION OF EXEMPLARY EMBODIMENTS

Hereinafter, exemplary embodiments of a semiconductor device according to the present disclosure will be described in detail with reference to the accompanying drawings.

1. Thermal Printer

Figure 1:
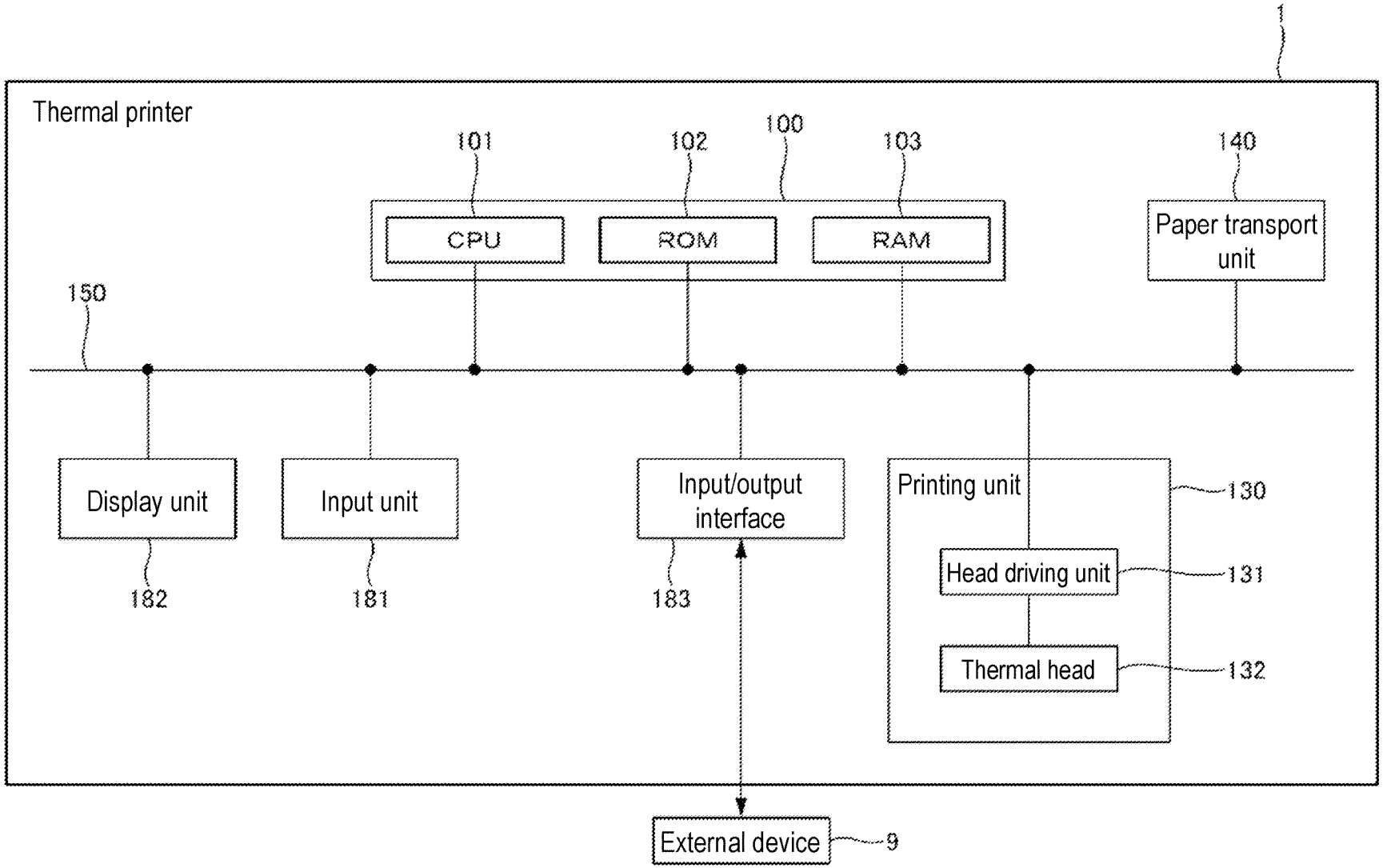
FIG. 1 is a diagram schematically showing an example of the block configuration of a thermal printer.

First, a thermal printer will be described prior to the description of the semiconductor device. FIG. 1 is a diagram schematically showing an example of the block configuration of the thermal printer. The thermal printer 1 shown in FIG. 1 includes a printer controller 100, a printing unit 130, a paper transport unit 140, and a system bus 150.

2. Printer Controller

The printer controller 100 controls the operations of the printing unit 130 and the paper transport unit 140 to print on recording paper. In FIG. 1, a CPU (Central Processing Unit) 101, a ROM (Read Only Memory) 102, and a RAM (Random Access Memory) 103 are shown as an example of the hardware configuration of the printer controller 100. These are coupled to the system bus 150 so as to communicate with each other.

The ROM 102 stores control programs and various data used for controlling the thermal printer 1. The ROM 102 is, for example, a non-volatile memory such as an EEPROM (Electrically Erasable Programmable Read Only Memory) and a flash memory.

The RAM 103 is used as a work memory that temporarily stores control programs and various data. The RAM 103 is, for example, a volatile memory such as a SRAM (Static Random Access Memory).

The CPU 101 is a processor that reads a control program from the ROM 102, temporarily stores the control program in the RAM 103, and then executes various processes according to the control program stored in the RAM 103. Specifically, the CPU 101 converts printing data input from an external device 9 into image data in a binary format. The image data refers to binary data representing an arrangement of dots on the recording paper. The CPU 101 expands the converted image data into an image buffer built in the RAM 103.

The CPU 101 reads the image data expanded into the image buffer line by line. The CPU 101 generates a printing data signal D based on the read image data and outputs the printing data signal D to the printing unit 130. The image buffer may be built in a storage device independently provided outside the RAM 103.

In addition, the thermal printer 1 includes an input unit 181, a display unit 182, and an input/output interface 183. These are coupled to the system bus 150. The input/output interface 183 mediates between the external device 9 and the system bus 150. The input/output interface 183 outputs the data sent from the external device 9 to the printer controller 100.

The input unit 181 accepts an input operation from a user. The hardware configuration of the input unit 181 includes a keyboard and a touch panel, for example. The display unit 182 displays or notifies an operating state of the thermal printer 1 by displaying a screen, emitting light from a light emitting indicator, or the like. The hardware configuration of the display unit 182 includes a liquid crystal display device and a light emitting diode device, for example.

3. Printing Unit

Figure 2:
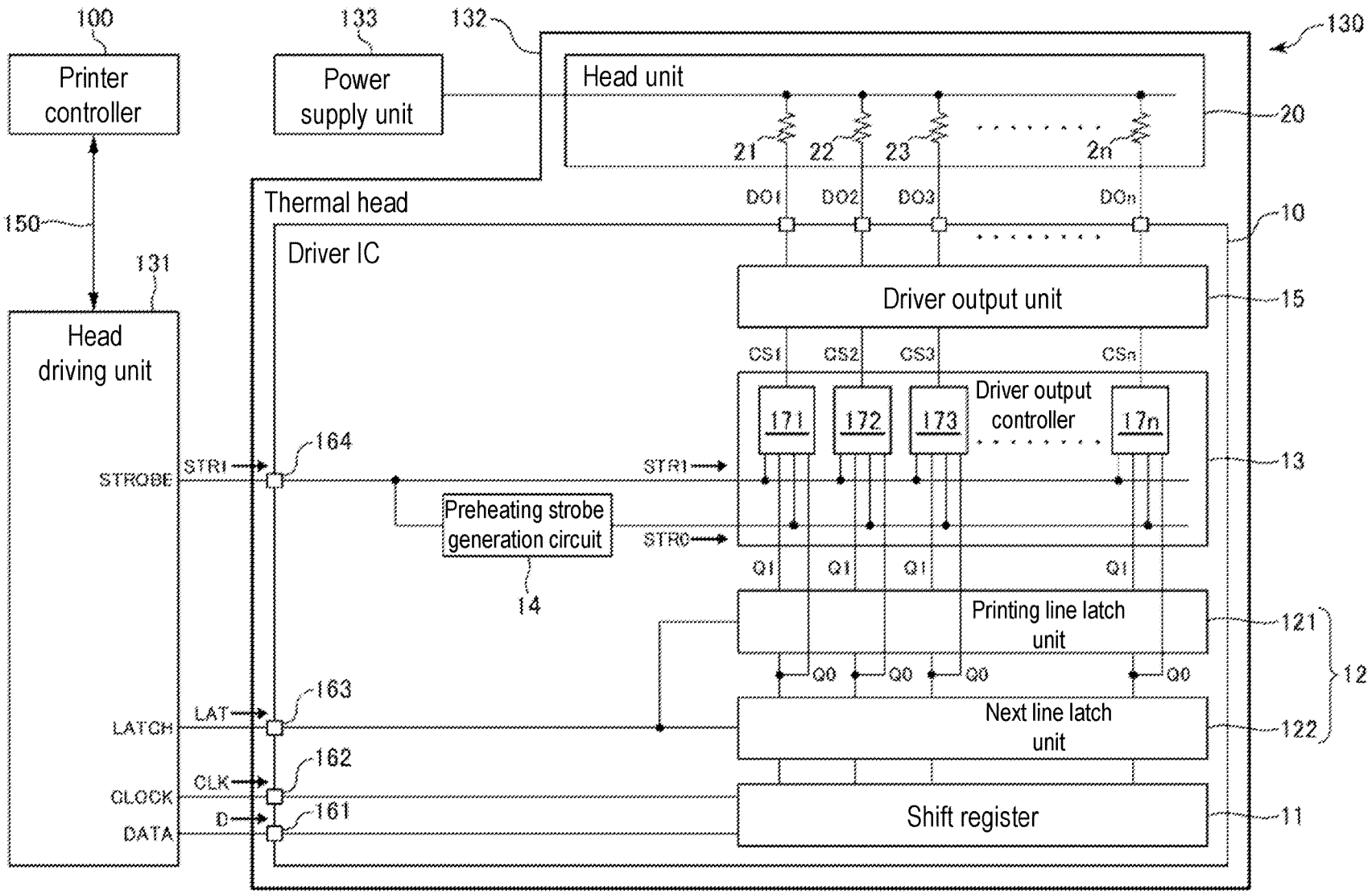
FIG. 2 is a diagram schematically showing the block configuration of a printing unit shown in FIG. 1.

FIG. 2 is a diagram schematically showing the block configuration of the printing unit 130 shown in FIG. 1. The printing unit 130 shown in FIG. 2 includes a head driving unit 131, a thermal head 132, and a power supply unit 133.

3.1. Head Driving Unit

The head driving unit 131 is coupled to the printer controller 100 via the system bus 150. The head driving unit 131 outputs various signals to a driver IC (Integrated Circuit) 10 based on the control from the printer controller 100. The signals include a printing data signal D, a clock signal CLK, a latch signal LAT, a printing strobe signal STR1, etc., which will be described later.

3.2. Thermal Head

The thermal head 132 shown in FIG. 2 includes the driver IC 10 serving as the semiconductor device according to the embodiment, and a head unit 20. The driver IC 10 controls energization of the head unit 20 based on the various signals described above. The head unit 20 includes a plurality of heating elements 21, 22, 23, . . . , and 2*n* corresponding to the number of pixels in one line. n is an integer of 1 or more and is set according to the number of pixels in one line. Therefore, the heating element 2*n* becomes a heating element 210 when n=10, and becomes a heating element 2100 when n=100, for example.

The heating elements 21, 22, 23, . . . , and 2*n* generate heat by energization based on energization conditions set by the driver IC 10. Printing is performed by transferring ink onto the recording paper or changing the color of the recording paper, which is composed of thermal paper, with the heat generated by the heating elements 21, 22, 23, . . . , and 2*n*. The type of the recording paper is not particularly limited. In addition, the printing includes not only printing of characters, symbols, etc., but also printing of patterns, figures, images, etc.

The plurality of heating elements 21, 22, 23, . . . , and 2*n* are arranged in a line direction. In the thermal head 132, dots for one line are simultaneously printed on the recording paper by individually selecting the plurality of heating elements 21, 22, 23, . . . , and 2*n* to generate heat or not. Furthermore, dots are printed over a plurality of lines by repeating the printing of dots for one line while moving the recording paper in a direction orthogonal to the line direction. As a result, dots are printed two-dimensionally, and a desired printing pattern can be obtained. The arrangement of the heating elements 21, 22, 23, . . . , and 2*n* is not particularly limited, and the heating elements 21, 22, 23, . . . , and 2*n* may be arranged in a plurality of lines.

3.3. Driver IC

The driver IC 10 has a function of controlling the driving of the head unit 20, and includes a shift register 11, a data latch 12, a driver output controller 13, a preheating strobe generation circuit 14, and a driver output unit 15. These functional units will be described later. The driver IC 10 further includes a printing data input terminal 161, a clock signal input terminal 162, a latch signal input terminal 163, a printing strobe signal input terminal 164, and output terminals DO1, DO2, DO3, . . . , and DOn. n is an integer of 1 or more and is set according to the number of pixels in one line. Therefore, the output terminal DOn becomes an output terminal DO10 when n=10, and becomes an output terminal DO100 when n=100, for example.

The printing data input terminal 161 is a terminal coupled to the shift register 11 and is a terminal to which the printing data signal D output from the head driving unit 131 is input. The printing data signal D includes a signal corresponding to the pixel to be printed.

The clock signal input terminal 162 is a terminal coupled to the shift register 11 and is a terminal to which the clock signal CLK output from the head driving unit 131 is input. The clock signal CLK defines, for example, a timing when the shift register 11 captures the printing data signal D.

The latch signal input terminal 163 is a terminal coupled to the data latch 12 and is a terminal to which the latch signal LAT output from the head driving unit 131 is input. The latch signal LAT defines, for example, a timing when the printing data signal D is transferred from the shift register 11 to the data latch 12.

The printing strobe signal input terminal 164 is a terminal coupled to the driver output controller 13 and is a terminal to which the printing strobe signal STR1 output from the head driving unit 131 is input. The printing strobe signal STR1 defines an energization time and an energization timing for the heating elements 21, 22, 23, . . . , and 2*n* for printing.

The output terminals DO1, DO2, DO3, . . . , and DOn are terminals for coupling the plurality of heating elements 21, 22, 23, . . . , and 2*n* and are terminals of an energization path that is switched by the driver output unit 15.

Next, the functional units of the driver IC 10 will be described. The shift register 11 includes the same number of cells (not shown) as the heating elements 21, 22, 23, . . . , and 2*n*. The shift register 11 holds the printing data for one line while shifting the printing data signal D sequentially input from the head driving unit 131 in synchronization with the clock signal CLK input from the head driving unit 131.

The data latch 12 temporarily stores the printing data for one line, respectively output from the cells of the shift register 11, by using the latch signal LAT input from the head driving unit 131 as a trigger.

The data latch 12 shown in FIG. 2 has a printing line latch unit 121 (first latch unit) and a next line latch unit 122 (second latch unit). The printing line latch unit 121 and the next line latch unit 122 respectively include a plurality of latch circuits (not shown) corresponding to the plurality of cells included in the shift register 11. Thus, the printing line latch unit 121 and the next line latch unit 122 temporarily store the printing data for one line, respectively. The data latch 12 shown in FIG. 2 may have three or more stages of latch units.

Furthermore, the printing data stored by the printing line latch unit 121 is output to the driver output controller 13 by using the latch signal LAT input from the head driving unit 131 as a trigger. The data output from the printing line latch unit 121 is referred to as "output data Q1." In addition, the printing data stored by the next line latch unit 122 is output to the printing line latch unit 121 and the driver output controller 13 by using the latch signal LAT input from the head driving unit 131 as a trigger. The data output from the next line latch unit 122 is referred to as "output data Q0."

The driver output controller 13 outputs control signals CS1, CS2, CS3, . . . , and CSn that are for switching energization of the heating elements 21, 22, 23, . . . , and 2*n* to the driver output unit 15 based on the output data Q1 and Q0 output from the data latch 12, the printing strobe signal STR1 output from the head driving unit 131, and the preheating strobe signal STR0 output from the preheating strobe generation circuit 14. n is an integer of 1 or more and is set according to the number of pixels in one line. Therefore, the control signal CSn becomes a control signal CS10 when n=10, and becomes a control signal CS100 when n=100, for example.

In addition, the driver output controller 13 shown in FIG. 2 includes the same number of control signal output circuits 171, 172, 173, . . . , and 17*n* as the heating elements 21, 22, 23, . . . , and 2*n*. The output data Q1 and Q0, the printing strobe signal STR1, and the preheating strobe signal STR0 are respectively input to the control signal output circuits 171, 172, 173, . . . , and 17*n*. Then, the control signal output circuits 171, 172, 173, . . . , and 17*n* respectively output the control signals CS1, CS2, CS3, . . . , and CSn for switching energization of the corresponding heating elements 21, 22, 23, . . . , and 2*n*. The configuration of the driver output controller 13 will be described in detail later.

The preheating strobe generation circuit 14 is a circuit that generates the preheating strobe signal STR0 by compressing the waveform of the printing strobe signal STR1 in a time axis direction. Because the preheating strobe signal STR0 preheats the heating elements 21, 22, 23, . . . , and 2*n* prior to printing, the energization conditions, that is, the energization time and the energization timing, for the heating elements 21, 22, 23, . . . , and 2*n* are defined. The configuration of the preheating strobe generation circuit 14 will be described in detail later.

The driver output unit 15 has switching elements (not shown) coupled to the heating elements 21, 22, 23, . . . , and 2*n*. A plurality of switching elements are provided corresponding to the heating elements 21, 22, 23, . . . , and 2*n*, and intermit the circuit for energization from the power supply unit 133 shown in FIG. 2 to the heating elements 21, 22, 23, . . . , and 2*n*. When the control signals CS1, CS2, CS3, . . . , and CSn output from the driver output controller 13 are active, the switching elements are turned on. As a result, the heating elements 21, 22, 23, . . . , and 2*n* are energized, and the heating elements 21, 22, 23, . . . , and 2*n* individually generate heat.

A delay circuit (not shown) may be provided on the input side of the printing strobe signal STR1 or the input side of the preheating strobe signal STR0 of the driver output controller 13, or delay circuits having different constants may be provided on both the input side of the printing strobe signal STR1 and the input side of the preheating strobe signal STR0. By doing so, the preheating strobe signal STR0 and the printing strobe signal STR1 are input to the driver output controller 13 as signals that the output time zones overlap in a part and do not overlap in another part, or as signals that the output time zones do not overlap each other at all.

3.4. Head Unit

The head unit 20 includes the plurality of heating elements 21, 22, 23, . . . , and 2*n* for printing image data for one line. The heating elements 21, 22, 23, . . . , and 2*n* are arranged in a straight line and form a row. The direction in which the heating elements 21, 22, 23, . . . , and 2*n* are arranged is referred to as the "line direction." The line direction is set with respect to the recording paper so as to be substantially parallel to a width direction of the recording paper that serves as the recording medium.

4. Paper Transport Unit

The paper transport unit 140 has a function of transporting the recording paper. The hardware configuration of the paper transport unit 140 includes, for example, a stepping motor and a motor driver (not shown). The motor driver drives the stepping motor based on the control of the printer controller 100. The stepping motor rotationally drives a paper feed roller (not shown). As a result, paper feed is executed as the printing for one line is repeated.

5. Operation Example of Driver IC

Figure 3:
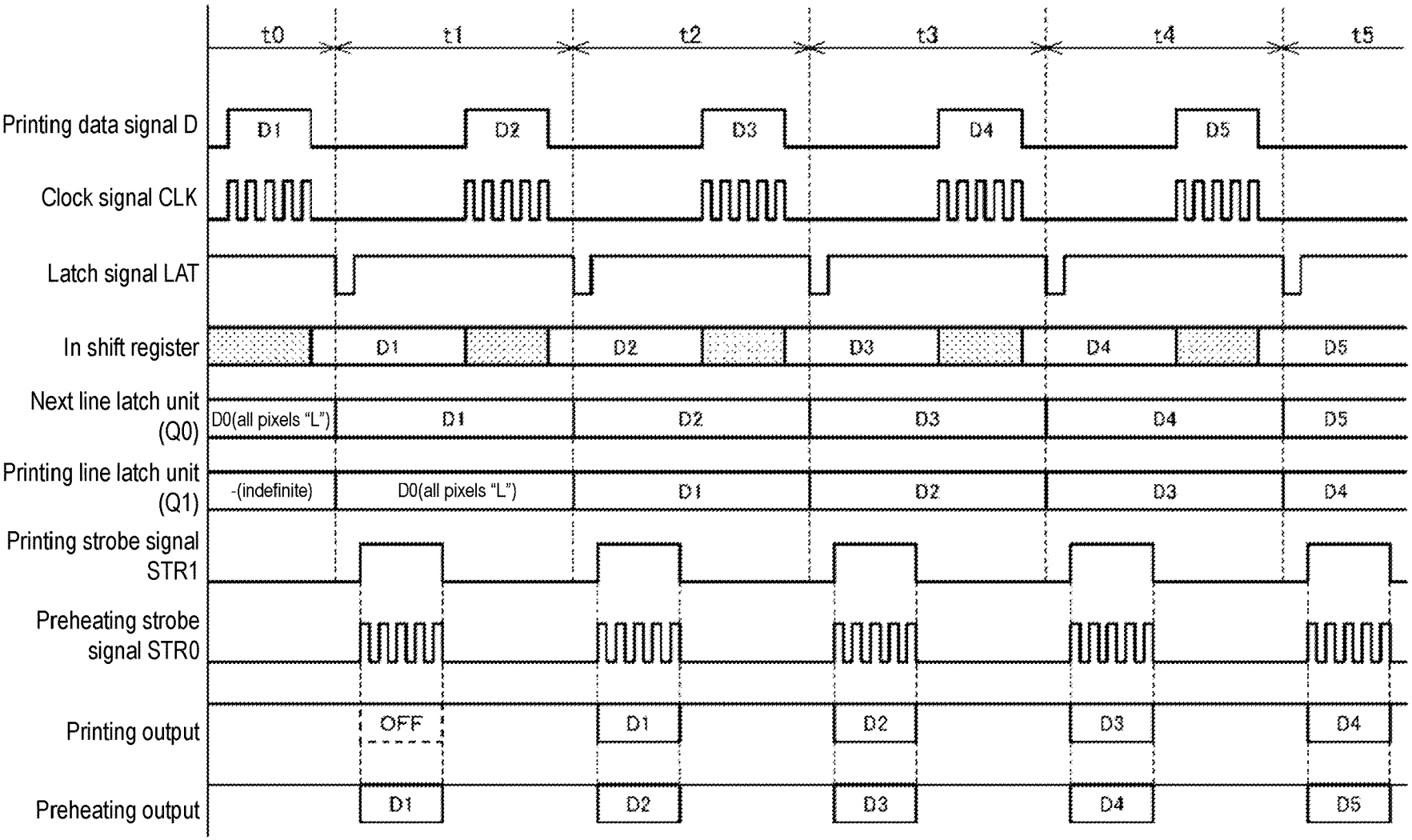
FIG. 3 is a timing chart for illustrating a printing operation of the thermal printer.

FIG. 3 is a timing chart for illustrating a printing operation of the thermal printer 1.

When printing on the recording paper, first, the printer controller 100 outputs the printing data signal D and control data to the head driving unit 131 based on the image data which is an image to be printed. The control data is data that defines the timing for storing the printing data in the data latch 12, the timing for activating the printing strobe signal STR1, etc., for example.

When performing the printing operation, various signals are output from the head driving unit 131 to the driver IC 10. First, the head driving unit 131 outputs the printing data signal D toward the printing data input terminal 161. Further, the head driving unit 131 outputs the clock signal CLK toward the clock signal input terminal 162.

The output printing data signal D is serially input to the shift register 11 in synchronization with the clock signal CLK, and the printing data for one line is held in the shift register 11. FIG. 3 shows an example in which the printing data D1 for one line for printing on the line L1, the printing data D2 for one line for printing on the line L2 next to the line L1, the printing data D3 for one line for printing on the line L3 next to the line L2, the printing data D4 for one line for printing on the line L4 next to the line L3, and the printing data D5 for one line for printing on the line L5 next to the line L4 are sequentially output to the shift register 11 and held. The printing data D1 to the printing data D5 respectively include signals corresponding to the respective pixels of the lines L1 to L5. The printing data D1 to the printing data D5 shown in FIG. 3 are, for example, signals that become active when the signal levels become high, and FIG. 3 shows, for example, a state where signals are output when printing is performed on all the pixels of lines L1 to L5.

Next, the head driving unit 131 outputs the latch signal LAT toward the latch signal input terminal 163 while the printing data D1 for one line is held in the shift register 11 in the period t1 shown in FIG. 3. The latch signal LAT shown in FIG. 3 is, for example, a signal that the data latch 12 takes the printing data when the signal level becomes low.

In addition, the period t0 before the period t1 is the initial state setting period of the data latch 12. In the period t0 shown in FIG. 3, the printing line latch unit 121 may store any data or no data. Further, the next line latch unit 122 shown in FIG. 3 stores the printing data D0 in which all pixels are at the low level, that is, inactive printing data D0 that does not print dots on one entire line.

In the data latch 12, the printing data D1 is taken from the shift register 11 into the next line latch unit 122 at the timing of the falling edge of the latch signal LAT during the period t1 shown in FIG. 3. Further, in the example of FIG. 3, the printing data D0 at the low level is taken into all the latch circuits of the printing line latch unit 121 in the period t1.

Next, the head driving unit 131 outputs the latch signal LAT again in the period t2 shown in FIG. 3, that is, a timing when the printing data D2 for one line is stored in the shift register 11 and the printing data D1 for one line is stored in the next line latch unit 122.

In the data latch 12, the printing data D1 stored in the next line latch unit 122 is taken into the printing line latch unit 121 at the timing of the falling edge of the latch signal LAT. As a result, in the period t2, the printing data D1 for one line is transferred to the printing line latch unit 121. At the same time, in the period t2, the printing data D2 is transferred from the shift register 11 to the next line latch unit 122. As a result, in the period t2, the printing data D2 for one line is stored in the next line latch unit 122.

Thereafter, in the period t3, the printing data D2 for one line is taken into the printing line latch unit 121, and the printing data D3 for one line is taken into the next line latch unit 122. In the period t4, the printing data D3 for one line is taken into the printing line latch unit 121, and the printing data D4 for one line is taken into the next line latch unit 122. In the period t5, the printing data D4 for one line is taken into the printing line latch unit 121, and the printing data D5 for one line is taken into the next line latch unit 122. As described above, the printing data is sequentially transferred to the shift register 11, the next line latch unit 122, and the printing line latch unit 121.

Here, the description refers back to the period t1 again. In the period t1, the head driving unit 131 outputs the printing strobe signal STR1 toward the printing strobe signal input terminal 164 at the timing of the falling edge of the latch signal LAT. The printing strobe signal STR1 shown in FIG. 3 is, for example, a signal that becomes active when the signal level becomes high.

The printing strobe signal STR1 is input to the plurality of control signal output circuits 171, 172, 173, . . . , and 17*n* included in the driver output controller 13, and is also input to the preheating strobe generation circuit 14.

Figure 4:
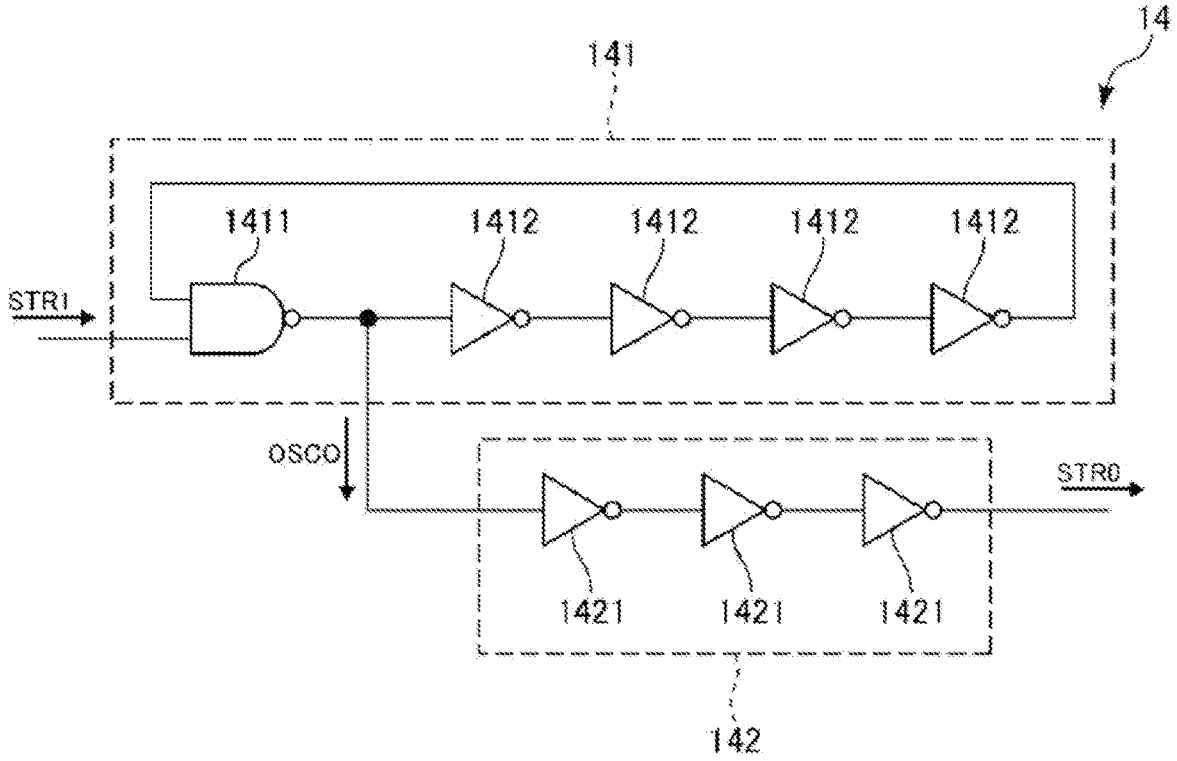
FIG. 4 is a circuit diagram showing the configuration of a preheating strobe generation circuit shown in FIG. 2.
Figure 5:
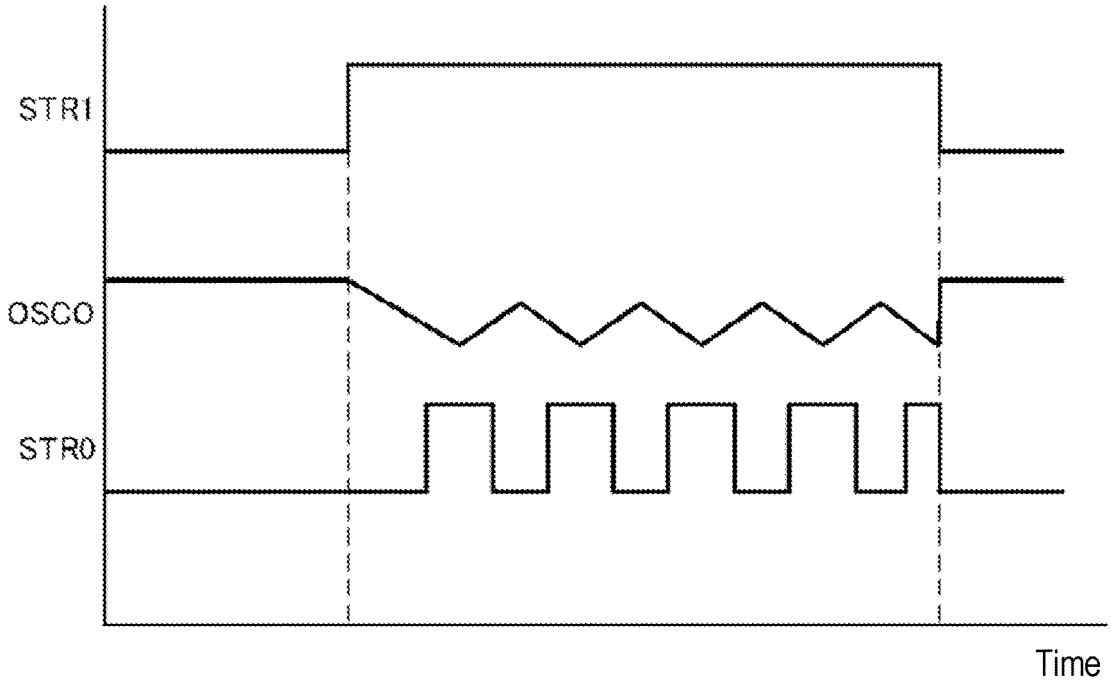
FIG. 5 is a figure showing examples of the waveform of a signal input to the preheating strobe generation circuit shown in FIG. 4, the waveform of a signal generated inside the preheating strobe generation circuit, and the waveform of a signal output from the preheating strobe generation circuit.

FIG. 4 is a circuit diagram showing the configuration of the preheating strobe generation circuit 14 shown in FIG. 2. FIG. 5 is a figure showing examples of the waveform of the signal input to the preheating strobe generation circuit 14 shown in FIG. 4, the waveform of the signal generated inside the preheating strobe generation circuit 14, and the waveform of the signal output from the preheating strobe generation circuit 14.

The preheating strobe generation circuit 14 shown in FIG. 4 is a circuit that compresses the waveform of the printing strobe signal STR1 in the time axis direction to generate and output the preheating strobe signal STR0. As shown in FIG. 5, the signal of the preheating strobe signal STR0 is a signal that becomes active for a shorter time than the printing strobe signal STR1 in the time zone when the printing strobe signal STR1 is active. According to such a preheating strobe signal STR0, as will be described later, the heating elements 21, 22, 23, . . . , and 2*n* can generate a heating amount to an extent that does not lead to printing. That is, preheating can be performed.

Therefore, if the lengths of times of being active are different between the waveform of the printing strobe signal STR1 and the waveform of the preheating strobe signal STR0, the shapes of one wave may be the same as or different from each other. FIG. 5 shows an example where both the printing strobe signal STR1 and the preheating strobe signal STR0 are rectangular waves, but when one is a rectangular wave, the other may be another waveform.

As described above, the thermal printer 1 includes the head unit 20 and the driver IC 10. The driver IC 10 is a semiconductor device that controls energization of the heating elements 21, 22, 23, . . . , and 2*n* of the thermal head 132 for printing, and has the printing strobe signal input terminal 164 (strobe signal input unit) that receives the printing strobe signal STR1 for the heating elements 21, 22, 23, . . . , and 2*n* to generate heat for printing, the preheating strobe generation circuit 14 that generates the preheating strobe signal STR0 for the heating elements 21, 22, 23, . . . , and 2*n* to preheat by compressing the waveform of the printing strobe signal STR1 in the time axis direction, and the driver output controller 13.

The preheating strobe signal STR0 is input to the driver output controller 13 in parallel to the printing strobe signal STR1. The driver output controller 13, which will be described later, outputs the control signals CS1, CS2, CS3, . . . , and CSn for controlling energization of the heating elements 21, 22, 23, . . . , and 2*n* based on the printing strobe signal STR1 and the preheating strobe signal STR0.

Such a driver IC 10 has a function of generating the preheating strobe signal STR0 which is for generating heat for preheating from the printing strobe signal STR1 which is for generating heat for printing in the preheating strobe generation circuit 14. By generating the preheating strobe signal STR0 inside the driver IC 10, as will be described in detail later, the heating elements 21, 22, 23, . . . , and 2*n* can generate a heating amount less than the heat generated for printing. Thus, in the driver IC 10, the heating elements 21, 22, 23, . . . , and 2*n* can perform the preheating operation without increasing the load on the printer controller 100. As a result, the time to the start of printing can be shortened and the printing speed of the thermal printer 1 can be increased without increasing the cost of the thermal printer 1.

In addition, when the heating for printing and preheating are alternately performed as in the related art, the printing operation cannot be performed during the preheating time, which results in the problem that the printing speed is lowered. In contrast thereto, in the present embodiment, for example, the heating elements that perform the printing operation and the heating elements that perform the preheating operation can coexist in one line. Therefore, in the present embodiment, the printing operation and the preheating operation can be performed at the same time, which has an advantage that the printing speed is further increased easily.

Here, the preheating strobe generation circuit 14 shown in FIG. 4 includes a chopper waveform generation unit 141 and a signal generation unit 142. The chopper waveform generation unit 141 is a circuit that generates a signal having a chopper waveform based on the printing strobe signal STR1. The chopper waveform refers to, for example, a vibration waveform in which the wave of a voltage such as a sine wave, a square wave, a triangular wave, and a pulse wave is repeated.

The signal generation unit 142 is a circuit that generates the preheating strobe signal STR0 based on the signal having the chopper waveform generated by the chopper waveform generation unit 141. Such a preheating strobe generation circuit 14 can easily generate a signal having a waveform compressed in the time axis direction based on the printing strobe signal STR1.

Furthermore, the chopper waveform generation unit 141 shown in FIG. 4 has an oscillation circuit. The oscillation circuit is, for example, a ring oscillator (ring oscillation circuit), a CR oscillation circuit, an LC oscillation circuit, and an a stable multivibrator. By using the oscillation circuit, the signal having the chopper waveform can be generated with a simpler circuit.

In addition, the oscillation circuit shown in FIG. 4 particularly has a ring oscillator. The ring oscillator is an oscillation circuit that further couples a plurality of series-coupled NOT gates (inverters) 1412 in a ring shape, and oscillates by utilizing the propagation delay of the NOT gates 1412. Because the circuit configuration is particularly simple, the ring oscillator is useful as an oscillation circuit for the driver IC 10.

The ring oscillator included in the chopper waveform generation unit 141 shown in FIG. 4 includes a NAND gate 1411 and four NOT gates 1412.

The printing strobe signal STR1 is input to one input terminal of the NAND gate 1411. The output terminal of the NAND gate 1411 is coupled to the input terminal of the four NOT gates 1412 coupled in series. The output terminal of the final stage NOT gate 1412 of the four NOT gates 1412 is coupled to the other input terminal of the NAND gate 1411 and is coupled in a ring shape. As a result, the output signal OSCO that oscillates by utilizing the propagation delay of the NOT gates 1412 can be output.

Further, the signal generation unit 142 is coupled between the output terminal of the NAND gate 1411 and the input terminal of the four NOT gates 1412 shown in FIG. 4. The signal generation unit 142 includes a plurality of NOT gates (inverters) 1421 coupled in series. The output signal OSCO from the chopper waveform generation unit 141 is input to the signal generation unit 142. The signal generation unit 142 has a function of shaping the signal waveform and outputting it as the preheating strobe signal STR0.

When the printing strobe signal STR1 has a rectangular wave as shown in FIG. 5, the output signal OSCO has a triangular wave as shown in FIG. 5, for example. Furthermore, the triangular wave of the output signal OSCO is converted by the signal generation unit 142 into, for example, the preheating strobe signal STR0 having a rectangular wave as shown in FIG. 5. In this way, the preheating strobe signal STR0 becomes a signal that is active for a shorter time than the printing strobe signal STR1 as shown in FIG. 5.

Nevertheless, the waveforms shown in FIG. 5 are examples, and for example, the preheating strobe signal STR0 is a signal that is active for a shorter time than the printing strobe signal STR1, that is, a signal obtained by compressing the waveform of the printing strobe signal STR1 in the time axis direction. In addition, the duty of the preheating strobe signal STR0 may be controlled by optimizing the determination level (threshold) of the NOT gate (inverter) 1412 or the NOT gate (inverter) 1421. The on-duty of the preheating strobe signal STR0 may be controlled to, for example, 50% or less, or 20% to 40%.

As described above, by generating the preheating strobe signal STR0 that is active for a shorter time than the printing strobe signal STR1, the heating elements 21, 22, 23, . . . , and 2*n* can perform the preheating operation with a heating amount less than the heating amount defined by the printing strobe signal STR1. Then, with the preheating strobe generation circuit 14 described above, the preheating strobe signal STR0 for performing such a preheating operation can be easily generated.

The preheating strobe signal STR0 generated by the preheating strobe generation circuit 14 is input together with the printing strobe signal STR1 to the plurality of control signal output circuits 171, 172, 173, . . . , and 17*n* included in the driver output controller 13.

The number of waves of the preheating strobe signal STR0 may be counted by a counter (not shown), and when the number of waves reaches a predetermined count, the operation of the preheating strobe generation circuit 14 may be stopped to stop the output of the preheating strobe signal STR0. The operation of the preheating strobe generation circuit 14 can be stopped, for example, by a switch circuit (not shown) provided on the input side of the printing strobe signal STR1 of the preheating strobe generation circuit 14. This switch circuit is configured to block the input of the printing strobe signal STR1 to the preheating strobe generation circuit 14 when the number of waves of the preheating strobe signal STR0 counted by the counter, that is, the above-mentioned count, reaches a predetermined value. With such a configuration, the width of the output time of the printing strobe signal STR1 and the width of the output time of the preheating strobe signal STR0 can be set different. The width of the output time in this case is for a certain number of printed characters, and is, for example, the length of the output time in units of one character.

Figure 6:
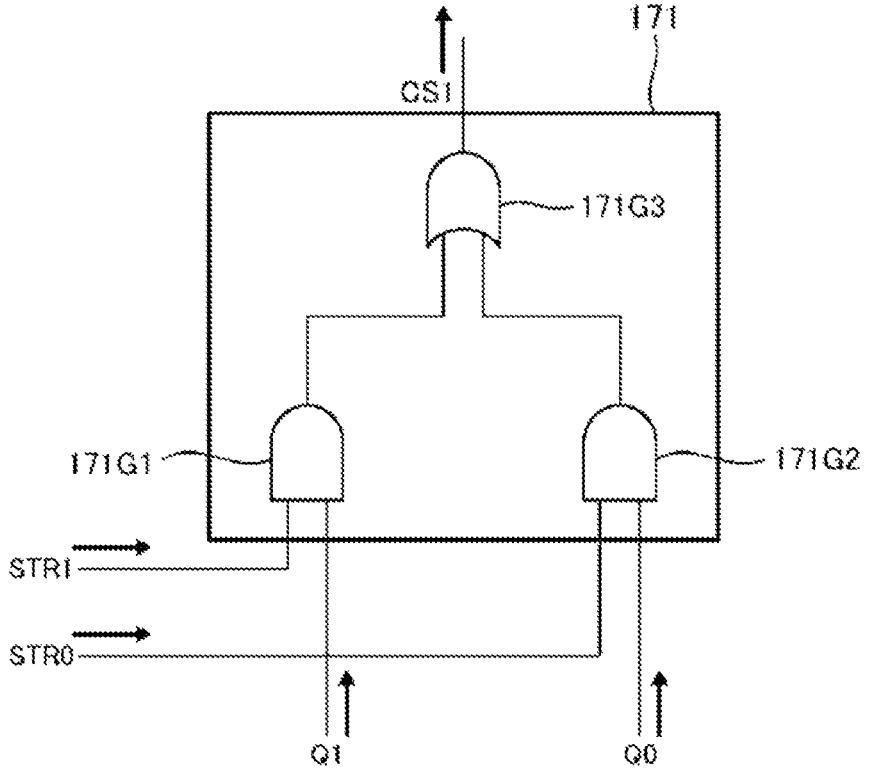
FIG. 6 is a circuit diagram showing the configuration of one control signal output circuit among a plurality of control signal output circuits shown in FIG. 2.

FIG. 6 is a circuit diagram showing the configuration of one control signal output circuit 171 among the plurality of control signal output circuits 171, 172, 173, . . . , and 17*n* shown in FIG. 2. The control signal output circuit 171 is a circuit that controls the control signal CS1 for switching energization of the heating element 21. Since the configurations of the other control signal output circuits 172, 173, . . . , and 17*n* are the same as the configuration of the control signal output circuit 171 described later, here the configuration, operation, etc. of the control signal output circuit will be described with reference to the control signal output circuit 171. n is an integer of 1 or more and is set according to the number of pixels in one line. Therefore, the control signal output circuit 17*n* becomes a control signal output circuit 1710 when n=10, and becomes a control signal output circuit 17100 when n=100, for example.

The control signal output circuit 171 shown in FIG. 6 includes two AND gates 171G1 and 171G2 and one OR gate 171G3.

The output data Q1 output from the printing line latch unit 121 is input to one input terminal of the AND gate 171G1. The printing strobe signal STR1 is input to the other input terminal of the AND gate 171G1. The AND operation of the output data Q1 and the printing strobe signal STR1 is performed in the AND gate 171G1. Therefore, when the output data Q1 is at the high level, during the period when the printing strobe signal STR1 is at the high level, the operation result of high level can be obtained. On the other hand, during the entire period when the output data Q1 is at the low level, or during the period when the printing strobe signal STR1 is at the low level even though the output data Q1 is at the high level, the operation result of low level can be obtained. The operation result is input to one input terminal of the OR gate 171G3.

The output data Q0 output from the next line latch unit 122 is input to one input terminal of the AND gate 171G2. The preheating strobe signal STR0 is input to the other input terminal of the AND gate 171G2. The AND operation of the output data Q0 and the preheating strobe signal STR0 is performed in the AND gate 171G2. Therefore, when the output data Q0 is at the high level, during the period when the preheating strobe signal STR0 is at the high level, the operation result of high level can be obtained. On the other hand, during the entire period when the output data Q0 is at the low level, or during the period when the preheating strobe signal STR0 is at the low level even though the output data Q1 is at the high level, the operation result of low level can be obtained. The operation result is input to the other input terminal of the OR gate 171G3.

The OR operation of the operation result of the AND gate 171G1 and the operation result of the AND gate 171G2 is performed in the OR gate 171G3. The operation result is output to the driver output unit 15.

In the period t1 shown in FIG. 3, for example, the printing data D0 at the low level is input to the control signal output circuit 171 as the output data Q1 and the printing data D1 is input to the control signal output circuit 171 as the output data Q0. Further, in the period t1, the printing strobe signal STR1 and the preheating strobe signal STR0 are also input to the control signal output circuit 171.

Then, in the period t1 shown in FIG. 3, the AND operation of the output data Q1 and the printing strobe signal STR1 is performed in the AND gate 171G1 so the operation result of low level is output. Therefore, in the period t1, the printing operation of the heating element 21 is not performed, and the printing output shown in FIG. 3 is OFF. On the other hand, the AND operation of the output data Q0 and the preheating strobe signal STR0 is performed in the AND gate 171G2. If the printing data D1 serving as the output data Q0 is data at the high level, the AND gate 171G2 outputs the operation result that intermittently becomes the high level based on the preheating strobe signal STR0 having a vibration waveform. Therefore, in the period t1, the preheating operation of the heating element 21 is performed, and the preheating output shown in FIG. 3 becomes active intermittently.

As a result, in the period t1, the OR gate 171G3 outputs the preheating output, that is, the operation result that intermittently becomes the high level.

The control signal output circuit 171 outputs the control signal CS1 based on the operation result of the OR gate 171G3 to the driver output unit 15. As a result, in the period t1, in the heating element 21 controlled by the control signal output circuit 171, the preheating operation is executed to generate heat to an extent that does not lead to printing. Thus, when the printing operation is performed in the next period t2, the temperature of the heating element 21 can be raised to some extent to perform printing immediately. Further, the preheating operation is performed based on the printing data D1 used for the printing operation of the heating element 21 in the period t2. Therefore, if the printing data D1 input to the control signal output circuit 171 in the period t1 is at the low level, the printing operation of the heating element 21 is not performed in the period t2 so the preheating operation of the heating element 21 in the period t1 becomes unnecessary. By preventing unnecessary preheating operation in this way, the power consumption of the thermal printer 1 can be reduced.

As described above, the control signal output circuit 171 shown in FIG. 6 is a circuit that includes the AND gate 171G1 (first AND gate), the AND gate 171G2 (second AND gate), and the OR gate 171G3. The AND gate 171G1 performs the AND operation of the output data Q1 (first data) and the printing strobe signal STR1. Further, the AND gate 171G2 performs the AND operation of the output data Q0 (second data) and the preheating strobe signal STR0. Furthermore, the OR gate 171G3 performs the OR operation of the operation result of the AND gate 171G1 and the operation result of the AND gate 171G2.

With such a circuit configuration, the control signal output circuit 171 can be realized, which despite the simple circuit configuration, can output the control signal CS1 so as to perform the necessary printing operation or preheating operation and not to perform the unnecessary preheating operation based on the data for the next line. As a result, the circuit scale of the control signal output circuit 171 can be prevented from increasing to reduce the cost of the driver IC 10.

The period t1 of the control signal output circuit 171 has been described above, but the same applies to the periods t1 of the control signal output circuits 172, 173, . . . , and 17*n*. In addition, the circuit configurations of the control signal output circuits 171, 172, 173, . . . , and 17*n* are not limited to those shown in the drawings.

In the period t2 shown in FIG. 3, the printing data D1 is input to the control signal output circuit 171 as the output data Q1 and the printing data D2 is input to the control signal output circuit 171 as the output data Q0. Further, similar to the period t1, in the period t2, the printing strobe signal STR1 and the preheating strobe signal STR0 are also input to the control signal output circuit 171.

Here, it is assumed that both the printing data D1 and the printing data D2 are at the high level. Then, in the AND gate 171G1, the operation result (printing output) that is continuously at the high level is output for a predetermined time. The predetermined time refers to a heat generation time during which printing can be performed by the heating element 21, and is defined by the printing strobe signal STR1. On the other hand, in the AND gate 171G2, the operation result that is intermittently at the high level is output based on the preheating strobe signal STR0 that has a vibration waveform. As a result, the OR gate 171G3 outputs the operation result (preheating output) that is continuously active for a predetermined time. Therefore, in the period t2, the OR gate 171G3 performs the OR operation of the printing output and the preheating output, and outputs the printing output, that is, the operation result that is continuously at the high level. Thus, in the period t2, the printing operation of the heating element 21 is performed.

As described above, since the control signal output circuit 171 has the OR gate 171G3, even if the printing operation and the preheating operation overlap in the period t2, the printing operation having a long heat generation time is selected. As a result, even if the preheating operation overlaps, there is no concern of interfering with the printing operation.

If the printing operation is performed, it is not necessary to perform the preheating operation so there is no interference from that viewpoint either. In addition, although FIG. 3 shows active low printing output and preheating output obtained by inverting active high operation results as an example, the printing output and the preheating output may be active high as described above.

As described above, the driver IC 10 includes the shift register 11 (data holding unit) that receives the input of the printing data signal D from outside and holds the content, and the data latch 12 (data storage unit) that temporarily stores the content of the printing data signal D held by the shift register 11, and the driver output controller 13 includes the control signal output circuits 171, 172, 173, . . . , and 17*n* that select the printing strobe signal STR1 or the preheating strobe signal STR0 based on the content of the printing data signal D stored in the data latch 12 and output it as the control signals CS1, CS2, CS3, . . . , and CSn.

With such a configuration, the heating elements 21, 22, 23, . . . , and 2*n* that require the printing operation can perform the printing operation, and the heating elements 21, 22, 23, . . . , and 2*n* that do not require the printing operation but require the preheating operation can perform the preheating operation. Thus, the preheating operation can be performed without interfering with the printing operation.

Furthermore, the data latch 12 is configured to separately store the output data Q1 (first data) corresponding to the printing for one line and the output data Q0 (second data) corresponding to the printing next to the printing of the output data Q1 as the content of the printing data signal D to be stored. In other words, the data latch 12 has the printing line latch unit 121 and the next line latch unit 122.

With such a configuration, the heating elements 21, 22, 23, . . . , and 2*n* can perform the preheating operation based on the output data Q0 output from the next line latch unit 122. Thus, the heating elements 21, 22, 23, . . . , and 2*n* of the pixels to be printed on the next line, that is, the pixels that require preheating, are accurately preheated. As a result, the unnecessary preheating operation is not performed so the power consumption of the thermal printer 1 can be reduced.

Moreover, the driver output controller 13 includes the plurality of control signal output circuits 171, 172, 173, . . . , and 17*n* that are coupled to the plurality of heating elements 21, 22, 23, . . . , and 2*n*. Therefore, as described above, it is possible to perform the preheating operation for each of the heating elements 21, 22, 23, . . . , and 2*n*, and the heating elements 21, 22, 23, . . . , and 2*n* that do not perform the printing operation can perform the preheating operation in preparation for the next printing. Thus, it is not necessary to secure a time for performing only the preheating operation so the printing speed can be increased.

Further, the preheating strobe signal STR0 and the printing strobe signal STR1 may be output in the same time zones as each other, but the output time zones may overlap in a part and not overlap in another part, or the output time zones may be completely different from each other and not overlap at all.

Here, any signal of the printing strobe signal STR1 is set as the "first printing strobe signal," and the signal generated from the first printing strobe signal, among the preheating strobe signals STR0, is set as the "first preheating strobe signal." When the time zone when the first printing strobe signal is output and the time zone when the first preheating strobe signal is output are partially or completely different, the flexibility in setting the timing of outputting the first preheating strobe signal can be increased. As a result, the heating elements can perform the preheating operation with higher accuracy.

In addition, the widths of the output times of the preheating strobe signal STR0 and the printing strobe signal STR1 may be different from each other. That is, if any of the heating elements 21 to 2*n* generates heat to an extent that does not lead to printing due to the preheating output, there may be a difference in the widths of the output times between the printing strobe signal STR1 and the preheating strobe signal STR0.

Specifically, when any signal of the printing strobe signal STR1 is set as the "first printing strobe signal" and the signal generated from the first printing strobe signal, among the preheating strobe signals STR0, is set as the "first preheating strobe signal," the width of the output time of the first printing strobe signal and the width of the output time of the first preheating strobe signal may be different. Thus, the flexibility in setting the preheating amount defined by the first preheating strobe signal can be increased. As a result, the heating element can perform the heating operation with higher accuracy. As described above, the width of the output time in this case is for a certain number of printed characters, and is, for example, the length of the output time in units of one character.

Furthermore, similar to the period t2 as described above, in and after the period t3, the heating elements 21, 22, 23, . . . , and 2*n* can also perform the preheating operation according to the printing operation to be performed in the next period.

Although not shown in the drawings, CMOS (Complementary Metal Oxide Semiconductor) inverters can be used in the control signal output circuits 171, 172, 173, . . . , and 17*n*. The CMOS inverter is a NOT gate that combines a p-channel MOSFET (Metal-Oxide-Semiconductor Field Effect Transistor) and an n-channel MOSFET.

The control signal output circuits 171, 172, 173, . . . , and 17*n* shown in FIG. 2 may have such CMOS inverters that control energization of the heating elements 21, 22, 23, . . . , and 2*n*. The CMOS inverter functions as a switch for driving a driver transistor included in the driver output unit 15.

In order for the CMOS inverter to function as a switch with sufficient driving capability, the cycle of the chopper waveform generated by the chopper waveform generation unit 141 described above may be longer than a response time of the CMOS inverter.

Thus, the vibration cycle of the preheating strobe signal STR0 generated based on the signal having the chopper waveform also becomes longer than the response time of the CMOS inverter. As a result, the CMOS inverter driven based on the preheating strobe signal STR0 can be prevented from failing to follow the vibration cycle of the preheating strobe signal STR0. Thus, the heating elements 21, 22, 23, . . . , and 2*n* can perform the accurate preheating operation.

Although the semiconductor device of the present disclosure has been described above based on the illustrated embodiment, the present disclosure is not limited thereto. For example, in the semiconductor device of the present disclosure, the configuration of each unit of the above embodiment may be replaced with any configuration having the same function, or any component may be added to the above embodiment.

What is claimed is:

1. A semiconductor device for controlling energization of a heating element that performs printing, the semiconductor device comprising:

a strobe signal input unit receiving a printing strobe signal that causes the heating element to generate heat for printing;

a preheating strobe generation circuit generating a preheating strobe signal that causes the heating element to preheat by compressing a waveform of the printing strobe signal in a time axis direction; and an output controller outputting a control signal that controls energization of the heating element based on the printing strobe signal and the preheating strobe signal.

2. The semiconductor device according to claim 1, wherein the preheating strobe generation circuit comprises:

a chopper waveform generation unit generating a signal having a chopper waveform based on the printing strobe signal; and a signal generation unit generating the preheating strobe signal based on the signal having the chopper waveform.

3. The semiconductor device according to claim 2, wherein the chopper waveform generation unit comprises an oscillation circuit.

4. The semiconductor device according to claim 3, wherein the oscillation circuit comprises a ring oscillator.

5. The semiconductor device according to claim 2, wherein the output controller comprises a CMOS inverter that controls energization of the heating element, and a cycle of the chopper waveform is longer than a response time of the CMOS inverter.

6. The semiconductor device according to claim 1, wherein when any signal of the printing strobe signal is set as a first printing strobe signal, and the preheating strobe signal generated from the first printing strobe signal is set as a first preheating strobe signal, a time zone when the first printing strobe signal is output and a time zone when the first preheating strobe signal is output are different.

7. The semiconductor device according to claim 1, wherein when any signal of the printing strobe signal is set as a first printing strobe signal, and the preheating strobe signal generated from the first printing strobe signal is set as a first preheating strobe signal, a width of an output time of the first printing strobe signal and a width of an output time of the first preheating strobe signal are different.

8. The semiconductor device according to claim 1, comprising:

a data holding unit receiving input of a printing data signal from outside and holding a content of the printing data signal; and a data storage unit temporarily storing the content of the printing data signal held by the data holding unit, wherein the output controller comprises a control signal output circuit that selects the printing strobe signal or the preheating strobe signal based on the content of the printing data signal stored in the data storage unit, and outputs a selected signal as the control signal.

9. The semiconductor device according to claim 8, wherein the data storage unit separately stores the content of the printing data signal into first data corresponding to printing for one line and second data corresponding to printing next to printing of the first data.

10. The semiconductor device according to claim 9, wherein the control signal output circuit comprises:

a first AND gate performing an AND operation of the first data and the printing strobe signal;

a second AND gate performing an AND operation of the second data and the preheating strobe signal; and an OR gate performing an OR operation of an operation result of the first AND gate and an operation result of the second AND gate.

11. The semiconductor device according to claim 8, wherein the output controller comprises a plurality of control signal output circuits coupled to a plurality of heating elements.

* * * * *